US005157366A

United States Patent [19]

Mullins et al.

[11] Patent Number: 5,157,366

[45] Date of Patent: Oct. 20, 1992

[54] CIRCUIT BREAKERS

[75] Inventors: Malcolm H. Mullins, Cambridgeshire; Frank Latham, Hertfordshire; Malcolm R. Snowball, Essex, all of England

[73] Assignee: M. K. Electric Limited, London, England

[21] Appl. No.: 650,801

[22] Filed: Feb. 6, 1991

[30] Foreign Application Priority Data

May 25, 1990 [GB] United Kingdom ..... 9011804

[51] Int. Cl.[5] ..... H01H 9/02

[52] U.S. Cl. ..... 335/8; 335/202; 361/353

[58] Field of Search ..... 361/353, 356, 363, 368, 361/376, 357, 360; 200/294, 291, 307; 335/8-10, 202

[56] References Cited

U.S. PATENT DOCUMENTS 2,689,282 9/1954 Wilckens .
4,004,197 1/1977 Hawkes, Jr. ..... 200/307
4,267,417 5/1981 Koepke ..... 200/307
4,347,488 8/1982 Mune et al. .
4,468,547 8/1984 Belttary .
4,727,226 2/1988 Comtois et al. ..... 200/307
5,001,315 3/1991 Runyan et al. ..... 200/307

FOREIGN PATENT DOCUMENTS 196241 2/1986 European Pat. Off. .
2427679 5/1978 France .

*Primary Examiner*—Lincoln Donovan
*Attorney, Agent, or Firm*—Amster, Rothstein & Ebenstein

[57] ABSTRACT

A circuit breaker comprises a housing (1) having a first face and an opposed second face, accessible electrical contacts (105, 106, 108, 115) exposed on each of the faces. An electrical connection is provided between at least one of the contacts (105) and an associated contact (106) on the second face. At least one further contact (108, 115) on the second face is engageable with the at least one contact (105, 112) on the first face of an adjacent circuit breaker.

28 Claims, 5 Drawing Sheets 105
100
101
108
106
105
100
101
100a
106
108
100
113
101
115
107

104
105
106
104
109
103
103
107
100
108
100
106
104
112
111
115
103
100
101
111
110
113
116
101
114
101

CIRCUIT BREAKERS

This invention relates to improvements in circuit breakers and is concerned with circuit breakers of the kind (hereinafter referred to as being of the "kind specified") which are manually operable to make or break an electric circuit and which, when making an electric circuit, respond to an electric signal to break the circuit.

There are many forms and constructions of circuit breaker and there are also system applications which incorporate a multiplicity of circuit breakers many of which are of identical construction and some of which are different.

It is an object of the present invention to provide an improved circuit breaker which can be used as a module in a system application and which is capable of being readily electrically connected to a similar module.

According to the present invention there is provided a circuit breaker of the kind specified comprising a housing having a first face and an opposed second face, accessible electrical contacts exposed on each of said faces, an electrical connection between at least one of the contacts exposed on the first face and an associated contact exposed on the second face and at least one further contact exposed on said second face engageable with said at least one contact exposed on the first face of an adjacent similar circuit breaker.

Preferably the first and second faces have complementary formations whereby the engagement of the formation on the first face with the complementary formation of the second phase of an adjacent similar circuit breaker operates physically to locate the circuit breaker with respect to such adjacent circuit breaker.

The formations may be part of the wall structure of the first and second faces or they may be part of the structure of the contacts or both.

With advantage the contacts are associated with the complementary formations and located within the boundaries thereof.

One embodiment of the present invention will now be described by way of example, reference being made to the accompanying drawings, in which.

Figure 1:
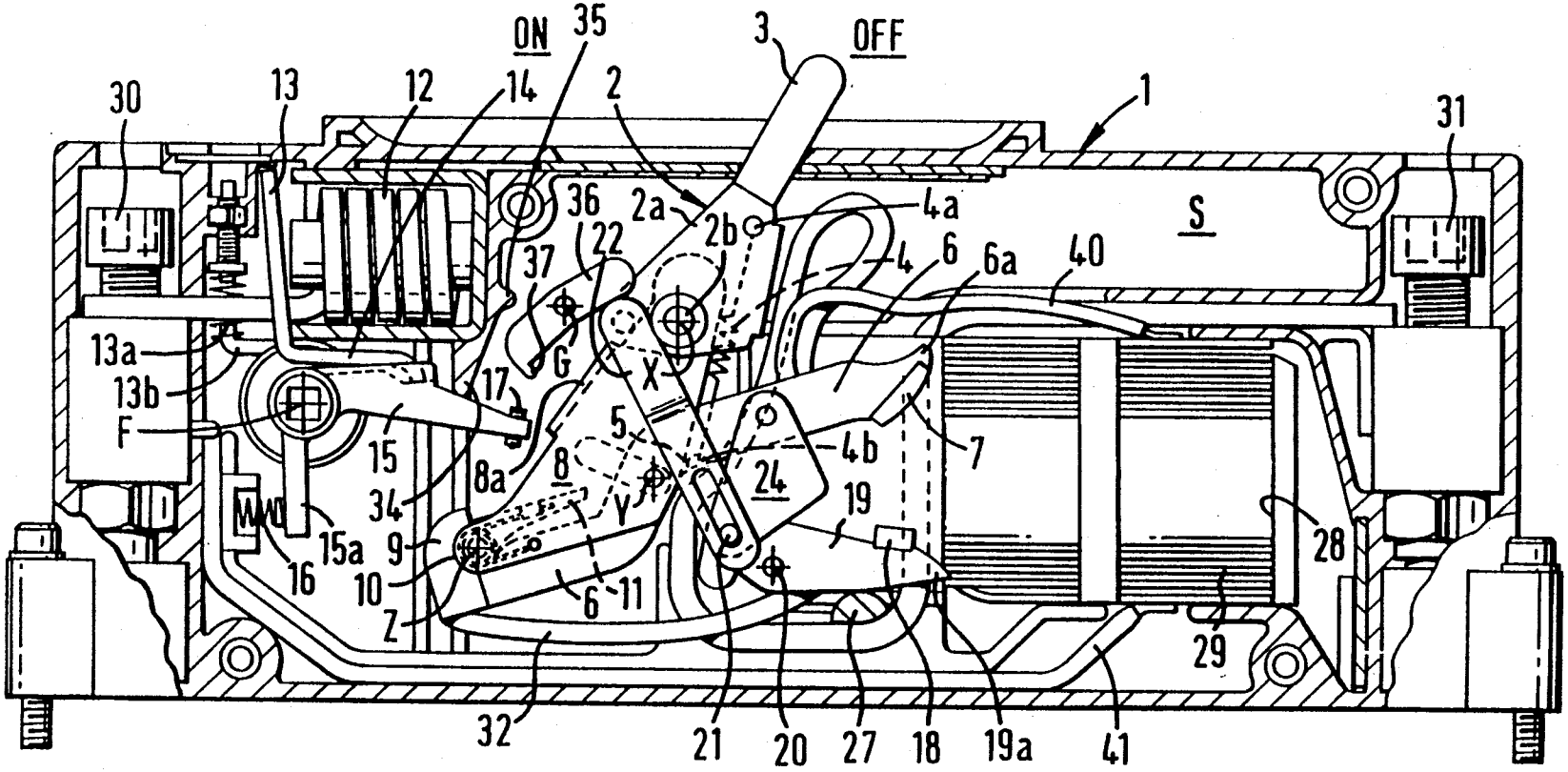
FIG. 1 illustrates the switch or circuit breaker described in our co-pending GB Patent Application No. 90 02678.2 and U.S. patent application No. of even date (Agents' Ref: 32814) the disclosure of which is incorporated herein by reference.
Figure 2:
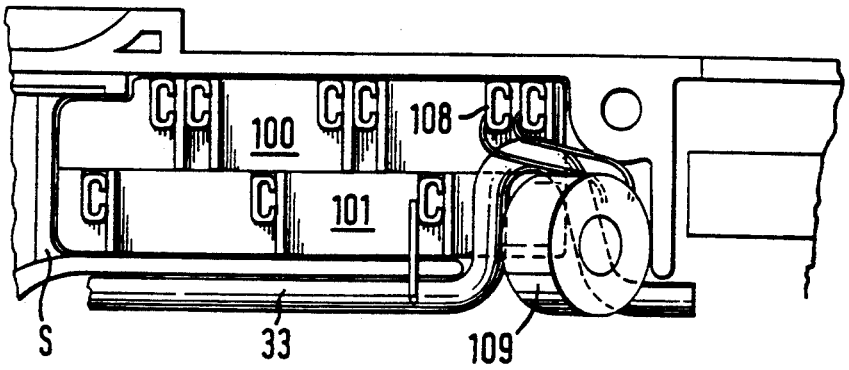
FIG. 2 is an elevational view of a structure which may be incorporated as a modification in the switch of FIG. 1 to provide an embodiment of the invention.
Figure 3:
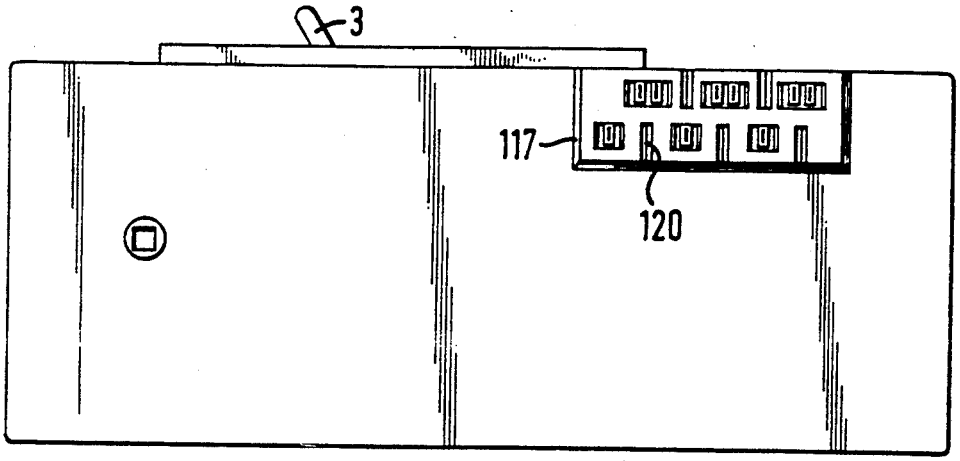
FIG. 3 is a side view of one face of the modified switch.
Figure 5:
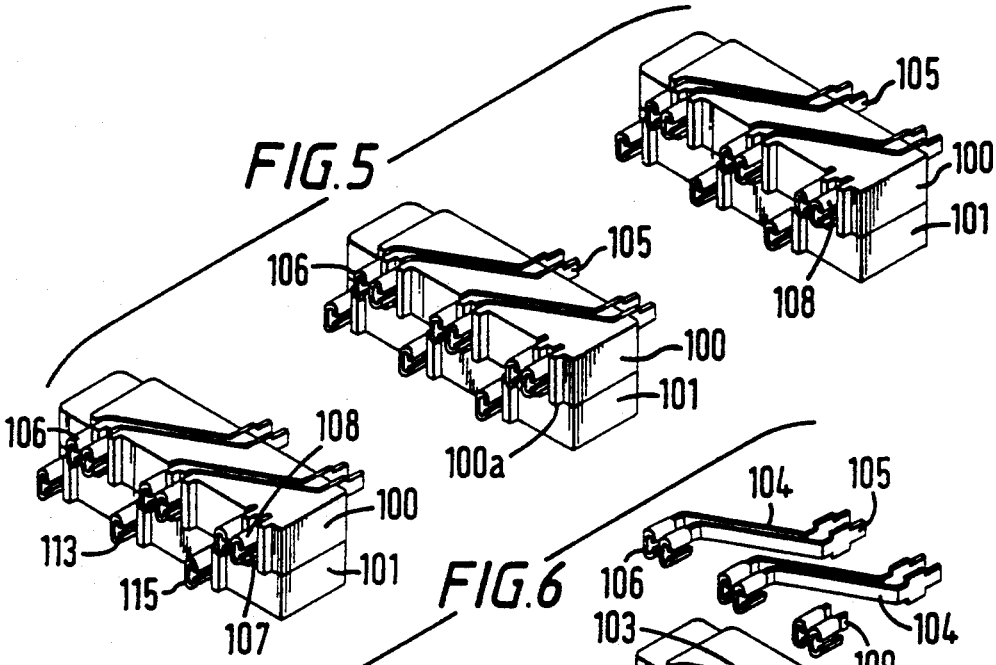
FIG. 5 is a perspective view of the three identical structures of the modification of FIG. 2 incorporated in the three interconnected switches.
Figure 6:
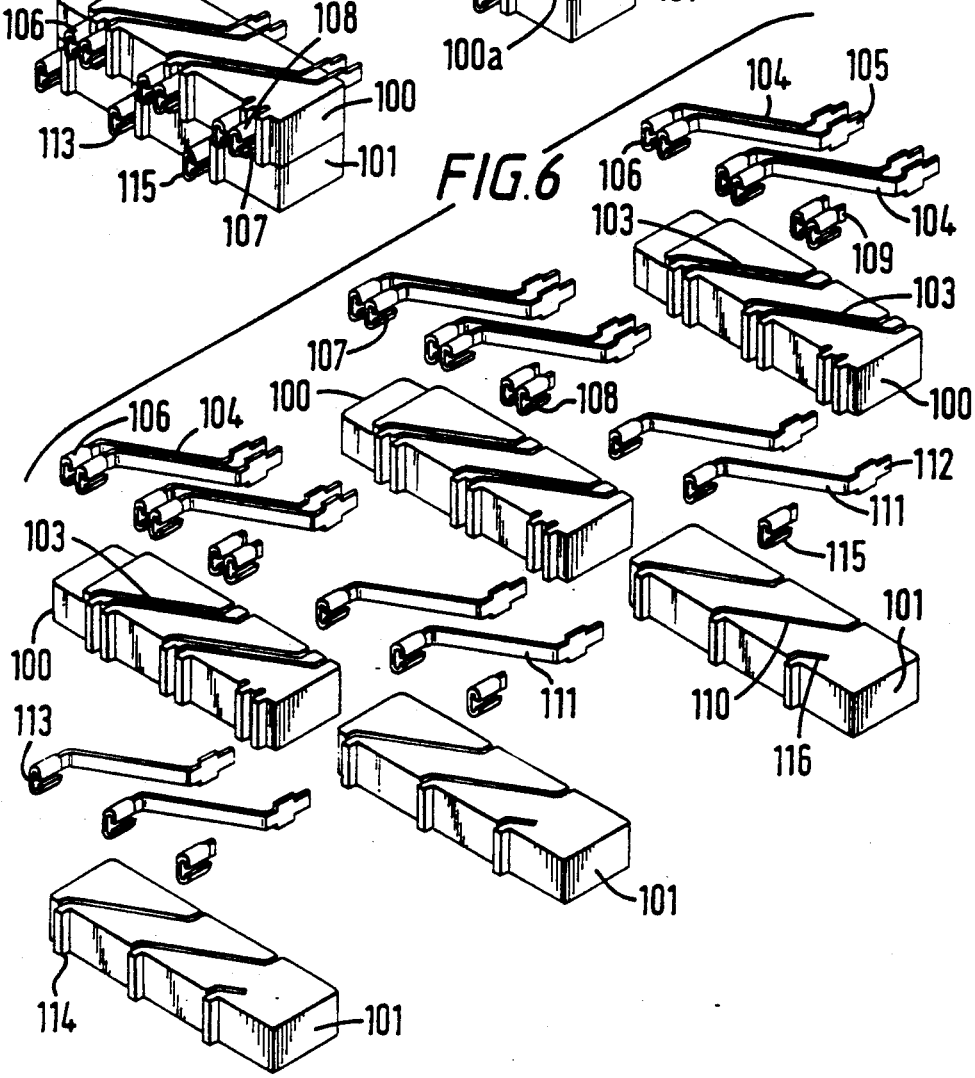
FIG. 6 is an exploded view showing the parts of the structures of FIG. 5.

FIG. 1 corresponds to FIG. 1 of the co-pending application referred to and carries the reference numbers used in that application, which numbers may be referred to herein as appropriate. The letter S is added to FIG. 1 to denote the space in which the modification of FIG. 2 is accommodated. The modification which is shown in FIG. 2 and FIGS. 5 and 6 comprises an upper moulding 100 and a lower moulding 101 both of an electrically insulating material. The upper face of the upper moulding 100 is formed with two pairs of parallel slots 103 to accommodate cranked terminal links 104 which terminate at one end in a male terminal 105 and at the other end in a female terminal 106. The latter are produced by folding the metal of the link to produce a male terminal receiving cavity which has a slot 107 which is faced towards a rib 100*a* formed on the front face of the moulding to locate and reinforce the female terminal 106 and to provide locating means for the moulding in the housing. The links 104 conduct current and voltage through the switch in which they are mounted.

The upper moulding 100 with the links 104 in place has two pairs of male terminals 105 projecting from one face (which will be referred to as the rear face) and two pairs of female terminals 106 projecting from the opposed or front face. Additionally there is provided a similar pair of female terminals 108 which have a short locating tail 109. The two pairs of links 104 provide a conducting path through a switch from one side to the other whereas the pair of terminals 108 are intended to receive a signal which does not necessarily originate with the switch concerned but which is to be identified or associated with that switch and to which the switch may well be intended to respond. In this example, the female terminals 108 are connected across a current transformer 109 (FIG. 2) which is connected across a pair of terminals and which is intended to actuate the switch when a predetermined circumstance or set of circumstances arises.

The lower moulding 101 has two spaced slots 110 similar to the slots 103 but only one slot instead of a pair of slots in each case. Each slot 110 accommodates a terminal link 111 which is identical to the terminal links 104 with a male terminal 112 at one end and a female terminal 113 at the other end, supported by a rib 114 on the moulding 101. These links 111 provide a through connection and an additional female terminal 115 with a short locating tail is provided in a further slot 116 for connection in this case to one phase of a 3-phase power supply. This terminal 115 is therefore connected to the conductor 33 (FIGS. 1 and 2) which in turn is connected to the terminal 31.

The crank in the links 104 and 111 displaces the female terminals laterally with respect to the associated male terminals by a uniform distance or step and the tailed female terminals 108 and 115 are disposed at one end of a row of such terminals. There is a uniform spacing between corresponding terminals of the pairs 106 and also the single female terminal 115. Thus when the upper mouldings 100 are pushed together, the male terminals 105 engage in the female terminals 106 located one step towards the terminals 108 which are identified with the switch concerned and the male terminals 112 engage in the female terminals 113 located one step towards the female terminal 115 identified with the switch concerned.

The female terminals are located in passages in the wall of the housing 1 and are protected thereby. The outer surface of this wall extends away from the general plane of the wall either by an increased thickness of the wall or by bulging the wall outwardly during manufacture. In any event, this part of the wall protrudes outwardly as at 117 (FIG. 4) and provides a projecting locating formation which is complementary to a corresponding recess 118 in the outer face of the opposed wall of the switch so that when two switches are placed side-by-side, face-to-face (in the same attitude) the projecting formation 117 of one locates in the recess 118 of the other.

The male terminals 105 and 112 project through the wall of the recess 118 to engage the respective female terminals and the depth of the recess 118 is not less than the extent to which the male terminals project in order to provide a degree of protection. Additionally, the outer face of the recess 118 is ribbed a at 119 to provide further protection for the projecting male terminals and to provide further guide means as two switches are mated as the projecting formation 117 has complementary recesses 120 and the ribs 119 and recesses 120 are tapered to provide additional guidance which also guides the male terminals into the female terminals.

Figure 4:
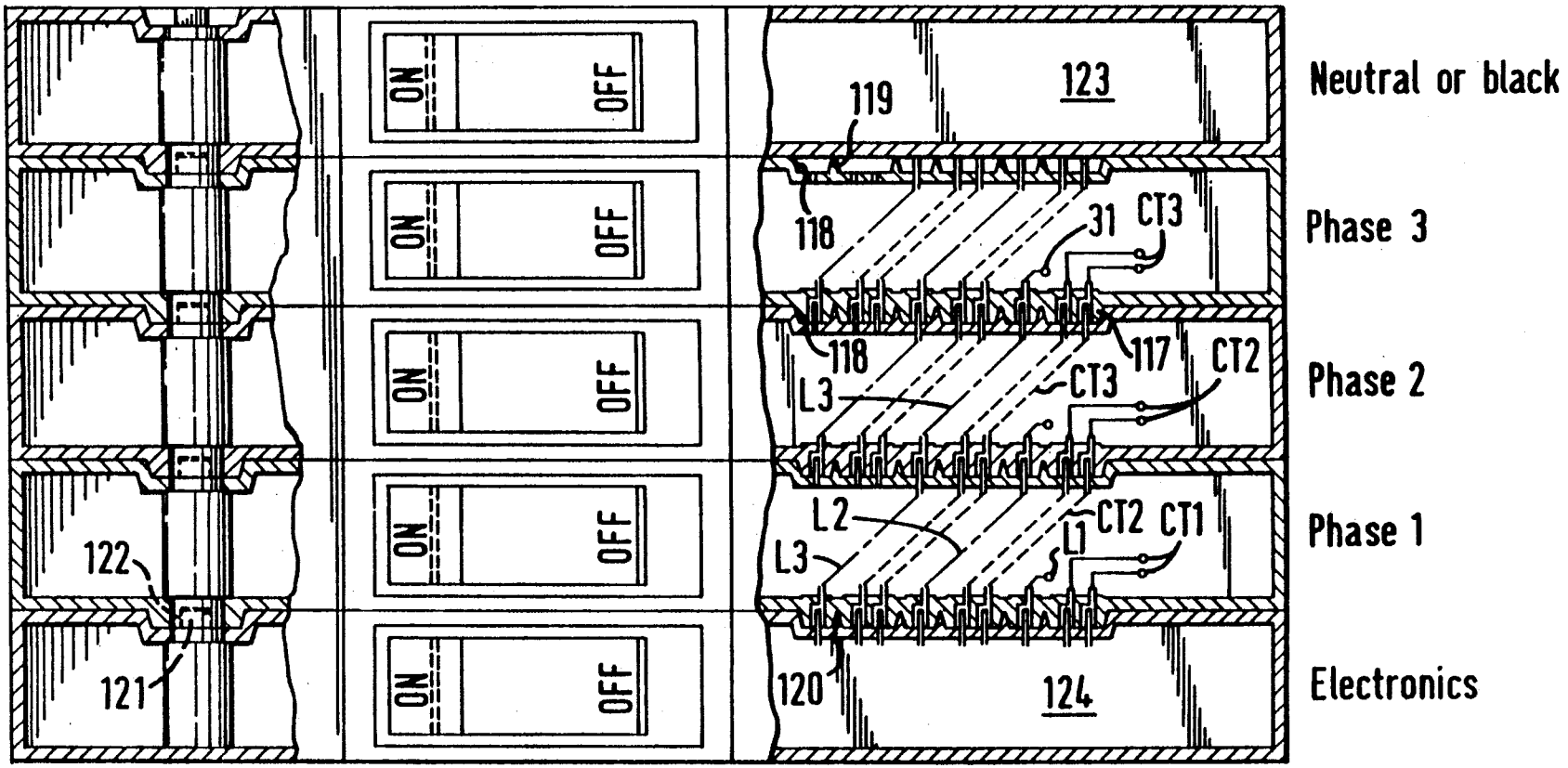
FIG. 4 is a top plan view with parts broken away of a system incorporating three modified switches interconnected and connected to the respective phases of a 3-phase supply.
Figure 7:
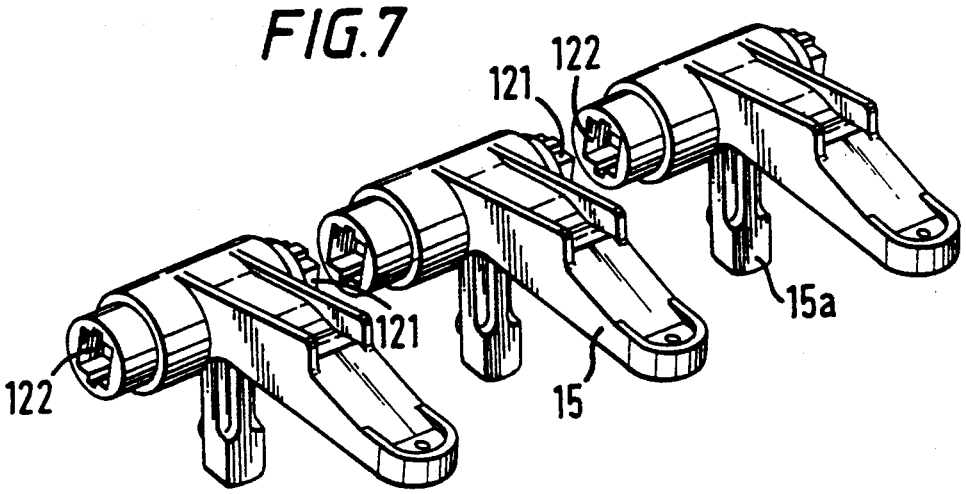
FIG. 7 is a perspective view of three spaced trip arms incorporated one in each of the three interconnected switches.
Figure 8:
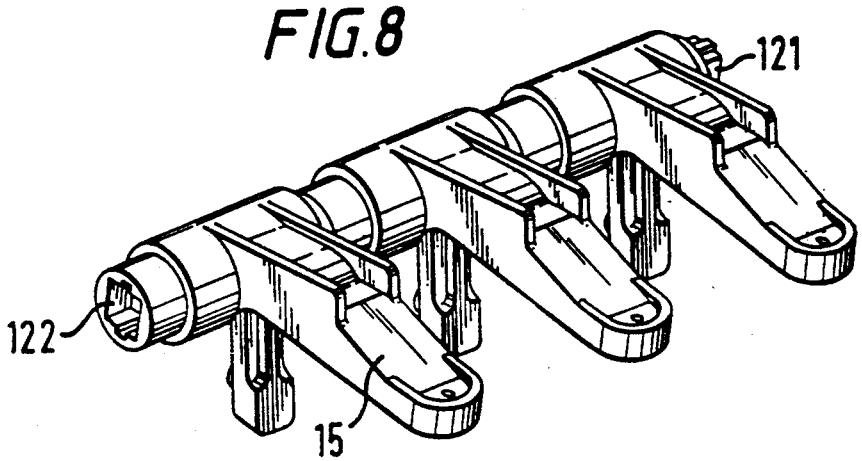
FIG. 8 shows the trip arms of FIG. 7 connected.

As can be seen in FIG. 4, the switches are also engaged in this example by a square section key 121 which projects from one face of a switch and engages in a complementary keyway 122 of the next adjacent switch. The key 1212 is in a recess 123 for protection and the keyway 122 is in a projection 124 which mates with the recess 123 to provide for guidance. The key 1212 and keyway 122 are part of an insulated actuating lever 15 (FIGS. 7 and 8) which can actuate the switch from the closed to the open condition when an actuating signal e.g. from the current transformer 109 is applied to the solenoid 12 to displace the armature 13. This rotates the lever 15 about the axis F and such rotation is transmitted by the key 121 and keyway 122 to the other switches so that when one is actuated they are all three actuated.

As shown in FIG. 4, the three modified switches are respectively associated with the line voltages of a 3-phase supply, phase 1 having a line voltage L1, phase 2 having a line voltage L2 and phase 3 having a line voltage L3. The current transformer signals are identified as CT1, CT2 and CT3. It can be seen that with the three switches connected by the male and female terminals in side-by-side relationship, not only will each switch respond to an appropriate current transformer signal to open its associated circuit and operate the other switches similarly, but all three line voltages L1, L2 and L3 appear at all times at the female terminals of the phase 1 switch together with all three current transformer signals CT1, CT2 and CT3.

The three phase switches shown in FIG. 4 are sandwiched between a switch unit 123 and an electroncis unit 124. The switch unit 123 is for connection to the neutral line of the supply and could well be a switch such as that shown in FIG. 1, modified as described or not. No current transformer is required and no female terminals are required to engage the male terminals of the adjacent phase 3 switch. The neutral switch does, however, have the connecting key and keyway of the other switches so that it will switch off with them. Some modification to the contacts would be required as the neutral switch should close before the phase switches and open last.

The electronics unit 124 is provided in one wall with the configuration of male terminals of the phase switches so that it can engage the female terminals of the adjacent phase 1 switch and have available to it the line voltages L1, L2 and L3 and the current transformer signals CT1, CT2, CT3, and is also provided with a key 121 which is engaged with the keyway of the next adjacent phase 1 switch and through which it can switch all the switches off.

The electronics unit 124 is intended to process or respond to the line voltages and current transformer signals in a predetermined manner which can vary from application to application and it will be apparent that its circuitry will be correspondingly tailored.

It will be appreciated that the switches are not necessarily linked by the keys 121 and keyways 122 and that they are not necessarily intended to be connected to the line voltages of a 3-phase supply. The important feature is that the three switch units described are identical and so can be mass produced and yet used in diverse applications and which can be used as modules which are simply and neatly electrically interconnected to provide a system at which any selected number of signal parameters are made available at one face of the combined and connected units for further processing or response. The invention is not limited to the three pairs of female contacts 106 and 108 in the upper moulding 100 and the three single female contacts 113 and 115 in the lower moulding 101 as these can be increased where a greater number of units is required to be connected for a specific application.

It is also to be understood that the invention is not limited to the use of male and female terminals although these are to be preferred as providing a more positive connection; any form of electrical contact means can be used to effect the desired electrical connection. Also, the switch need not necessarily be that described in the co-pending application referred to and illustrated in FIG. 1 but should incorporate means for switching from the "ON" to the "OFF" condition in response to an electric signal to disconnect or break an electric circuit.

It will be noted that by providing the male and female terminals described these terminals, when engaged do, in fact, operate physically to locate one switch with respect to an adjacent switch and can therefore be considered to act as physical locating means. However, as protruding male terminals should desirably be protected from damage, it is preferred that they be provided in a recess in the housing wall, and, as they must extend into a female terminal, it is efficient to locate the latter in a protruding wall portion which is complementary to the configuration of the recess to provide additional physical location. Such additional physical location provided by the housing walls can of itself be sufficient to ensure correct physical location in which case the terminals need not be male and female terminals but could be simple contacts with means provided to hold two switches together with the contacts engaged and the switches located by the physical configuration of the housing walls.

We claim:

1. A circuit breaker comprising a housing having a first face and an opposed second face, accessible electrical contacts exposed on each of said faces, an electrical connection between at least one of the contacts exposed on the first face and an associated contact exposed on the second face and at least one further contact exposed on said second face engageable with said at least one contact exposed on the first face of an adjacent similar circuit breaker.

2. A circuit breaker according to claim 1 in which said one further contact exposed on said second face is constructed physically to engage said at least one contact exposed on the first face of an adjacent similar circuit breaker to effect an electric connection and physically to locate the circuit breaker with respect to such adjacent similar circuit breaker.

3. A circuit breaker according to claim 2 in which all the contacts exposed on the first face are female terminals or are male terminals and all the contacts exposed on the second face are male terminals or are female terminals.

4. A circuit breaker according to claim 3 in which the male terminals project from the face on which they are exposed and are protected by being located in a recess and the female terminals are located in a projection or bulge of the face on which they are exposed to enable them to be presented to and receive the male terminals of the adjacent similar circuit breaker.

5. A circuit breaker according to claim 4 in which the projection or bulge has a configuration complementary to that of the recess so that when the male or female terminals of the circuit breaker engage the female or male terminals of the adjacent similar circuit breaker the projection or bulge of one circuit breaker engage the recess of the adjacent similar circuit breaker physically to locate the circuit breaker with respect to the adjacent similar circuit breaker.

6. A circuit breaker according to claim 1 in which the first and second faces have complementary formations whereby the engagement of the formation on the first face with the complementary formation of the second phase of an adjacent similar circuit breaker operates physically to locate the circuit breaker with respect to such adjacent circuit breaker.

7. A circuit breaker according to claim 6 in which the formations are part of the wall structure of the first and second faces.

8. A circuit breaker according to claim 7 in which the contacts are associated with the complementary formations.

9. A circuit breaker according to claim 6, in which the formations are part of the structure of the contacts.

10. A circuit breaker according to claim 9 in which the contacts are male and female terminals.

11. A circuit breaker according to claim 1 in which said one further contact exposed on said second face is electrically isolated from any contact exposed on said first face.

12. A circuit breaker according to claim 1 in which said at least one contact exposed on said first face is disposed opposite said further contact on the second face and said associated contact is spaced from said associated contact by a predetermined uniform distance.

13. A circuit breaker according to claim 12 in which a first plurality of contacts is exposed on said first face arranged in a first row and spaced by said uniform distance and a corresponding plurality of first associated contacts is exposed on said second face arranged in a second row which is parallel to the first row, the plurality of first associated contacts being spaced by said uniform distance.

14. A circuit breaker according to claim 13 in which a second plurality of contacts is exposed on said first face in said first row and spaced by said uniform distance and a corresponding plurality of second associated contacts is exposed on said second face in said second row and spaced by said uniform distance.

15. A circuit breaker according to claim 14 in which each of the first plurality of contacts is associated with a corresponding one of the second plurality of contacts to provide a first plurality of pairs of contacts exposed on said first face and each of the plurality of first associated contacts is associated with a corresponding one of the plurality of second associated contacts to provide a second plurality of pairs of contacts exposed on said second face and associated with the respective first plurality of pairs of contacts exposed on said first face.

16. A circuit breaker according to claim 15 in which a pair of said further contacts is provided exposed on said second face, said pair of said further contacts being in said second row at one end thereof and being engageable with the end-mot pair of said first plurality of pairs of contacts exposed on the said one face of an adjacent similar circuit breaker.

17. A circuit breaker comprising a housing having a first face and an opposed second face, accessible electrical contacts exposed on each of said faces, an electrical connection between at least one of the contacts exposed on the first face and an associated contact exposed on the second face and at least one further contact exposed on said second face engageable with said at least one contact exposed on the first face of an adjacent similar circuit breaker, said electrical connection between the contacts exposed on said first face and said associated contact exposed on said second face being a cranked electrically conducing link extending between said opposed faces.

18. A circuit breaker according to claim 17 in which the cranked link is mounted in a slot in a support carried within the housing between the opposed faces.

19. A circuit breaker according to claim 18 in which the support is in two parts.

20. A circuit breaker according to claim 19 in which each part supports a plurality of contacts extending between said first and second faces.

21. A circuit breaker according to claim 20, in which one part of the support supports the pairs of contacts exposed on said first face said second plurality of pairs of contacts exposed on said second face and the other part of the support supports a further plurality of contacts of which a first set is exposed on said first face and a second set is exposed on said second face, said contacts of the first and second sets being electrically connected.

22. A circuit breaker according to claim 21 in which the contacts supported on the first part comprise two pairs of contacts exposed on said first face and three pairs of contacts exposed on said second face and the contacts supported on the other part comprise two spaced single contacts exposed to said first face and three spaced single contacts exposed to said second face.

23. A circuit breaker according to claim 22 in which the third of said three pairs of contacts is electrically connected across a current transformer mounted within the housing and the third of said three spaced single contacts is electrically connected in the housing to a conductor connected to a terminal for connection to phase supply line.

24. A circuit breaker comprising a housing having a first face and an opposed second face, accessible electrical contacts exposed on each of said faces, an electrical connection between at least one of the contacts exposed on the first face and an associated contact exposed on the second face and at least one further contact exposed on said second face engageable with said at least one contact exposed on the first face of an adjacent similar circuit breaker, an actuating lever operable to actuate the circuit breaker from the closed to the open condition, said lever being provided with or connected to a key which extends from one of said first and second faces, and a complementary keyway associated with the other of said first and second faces and engageable by the key of the adjacent similar circuit breaker, whereby operation of said actuating lever actuates the circuit breaker and the adjacent similar circuit breaker.

25. A circuit breaker according to claim 24 in which the key projects from the face on which the male terminals are exposed and is located in a further recess and the keyway is located in a further projection or bulge on the opposed face to enable it to be presented to the key of the adjacent similar circuit breaker.

26. A circuit breaker according to claim 25 in which the further recess and further projection or bulge are of complementary configuration physically to locate the circuit breaker with respect to the adjacent similar circuit breaker.

27. A system comprising at least two circuit breakers according to claim 1 disposed in side-by-side relationship in which the electrical contacts exposed on the second face of at least one such circuit breaker is electrically engaged with the contacts exposed on the first face of the adjacent similar circuit breaker.

28. A circuit breaker comprising three housings disposed in series, each having a first face and an opposed second face, accessible electrical contacts exposed on each of said faces, an electrical connection between at least one of the contacts exposed on the first face and an associated contact exposed on the second face, and at least one further contact exposed on said second face engaged with said at least one contact exposed on the first face of an adjacent similar circuit breaker, said at least one contact exposed on said first face being engaged with said at least one further contact exposed on the second face of another adjacent similar circuit breaker.

* * * * *